United States Patent [19]

Hama et al.

[11] Patent Number: 4,751,507

[45] Date of Patent: Jun. 14, 1988

[54] METHOD FOR SIMULTANEOUSLY DISPLAYING AN IMAGE AND AN ENLARGED VIEW OF A SELECTABLE PORTION OF THE IMAGE WITH DIFFERENT LEVELS OF DOT DETAIL RESOLUTION

[75] Inventors: Hiroshi Hama, Yokohama; Yasukazu Isobe, Fujisawa, both of Japan

[73] Assignee: International Business Machines Corporation, Armonk, N.Y.

[21] Appl. No.: 729,327

[22] Filed: May 1, 1985

[30] Foreign Application Priority Data

Jul. 23, 1984 [JP] Japan ..... 59-151475

[51] Int. Cl.[4] ..... G09G 3/00

[52] U.S. Cl. ..... 340/724; 340/731; 340/721; 340/750; 340/709

[58] Field of Search ..... 340/709, 731, 721, 745, 340/744, 750, 724

[56] References Cited

U.S. PATENT DOCUMENTS

| | | | |
|---|---|---|---|
| Re. 31,200 | 4/1983 | Sukonick et al. | 340/744 |
| 4,190,834 | 2/1980 | Doornink | 340/709 |
| 4,354,184 | 10/1982 | Woborschil | 340/709 |
| 4,495,491 | 1/1985 | Postl | 340/709 |

*Primary Examiner*—Marshall M. Curtis

[57] ABSTRACT

A method is disclosed for creating simultaneously viewable coarse and fine resolution displays, respectively presenting an "entire image" with coarse resolution of detail and a selected portion of that image in an enlarged view with fine resolution of detail. The method also provides for creation of cursor and crosshair images overlying the portion of the coarse display selected for enlarged viewing, and creation of an enlarged crosshair image overlying the enlarged display. The cursor image is in the form of a rectangle outlining the portion selected for "magnified" viewing in the fine display segment. The crosshairs provide relatively scaled position references on the coarse and fine views for enabling operators to accurately locate points within fine segments for specification to a computer system.

6 Claims, 6 Drawing Sheets

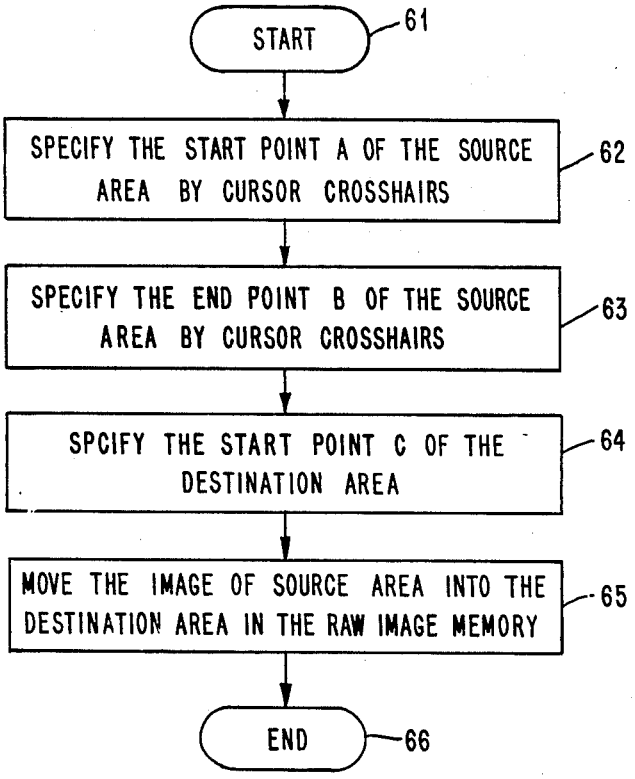
FIG. 6
FIG. 7
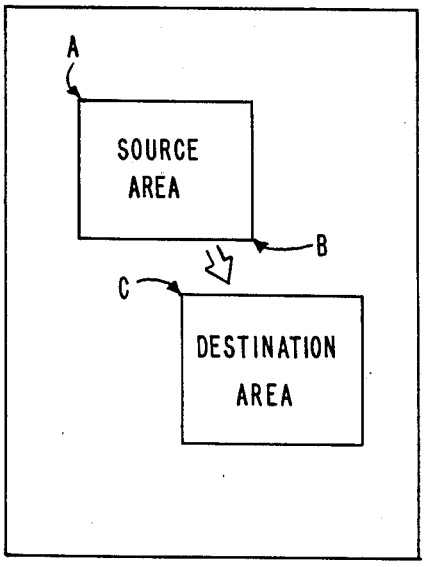

METHOD FOR SIMULTANEOUSLY DISPLAYING AN IMAGE AND AN ENLARGED VIEW OF A SELECTABLE PORTION OF THE IMAGE WITH DIFFERENT LEVELS OF DOT DETAIL RESOLUTION

FIELD OF THE INVENTION

This invention relates to a method for creating display effects particularly useful for computer controlled graphic applications and the like. In particular, the invention relates to a method for creating simultaneously viewable coarse and fine resolution display images; characterized in that the coarse image corresponds to an "entire" image representation stored in a fine resolution form in a computer memory buffer, but presents a coarsely reduced pel (spot detail) representation of that image, whereas the fine display image presents a portion of the entire image but in an enlarged view containing all of the details available in the stored representation of that portion. The invention also relates to the creation of an outlining cursor image overlying the coarse image view at the location of the portion co-displayed in fine detail, and to the creation of relatively scaled crosshair images overlying both the coarse and fine image views for effectively providing viewing operators with accurate position selection information relative to areas outlined by the cursor.

PRIOR ART

Japanese published unexamined patent application 53-90822 discloses a technique for displaying enlarged portions of a stored image representation, together with an enlargement indicator. the enlargement indicator is a square shaped form divided into smaller boxes. One of the boxes is selected by a viewing operator and a partial image associated with the selected box is displayed in enlarged form. The indicator, however, only indicates an outline of the dimensions of the entire image representation, which does not permit an operator to view the representation itself. Thus, the operator may lack information which he could otherwise use as an aid to finding a specific portion of the entire image to view and/or manipulate.

PROBLEM SOLVED BY THE INVENTION

Generally, the screen of a display device may be unable to display as many pel (picture element) positions as are available in a stored representation of a document image. Thus, in order to display a full page image on a display screen, it may be necessary to reduce the pel resolution of the source representation for that image.

In these and other circumstances, it is necessary to be able to simultaneously display portions of a full page image in detail. In the situation where a full page is displayed with reduced resolution, the full image is viewable but its details are not. In the situation where details of a part of a full page are viewable the entire image is not.

As described hereinbefore, display of both a general enlargement indicator and a detailed partial image is known, but has the disadvantage that the operator cannot simultaneously view the entire image. This requires alternately viewing the entire image and selected portions of that image for many process applications. But, it renders precise selection of a desired partial area in the full image difficult, since the full image has coarse (low) resolution.

SUMMARY OF THE INVENTION

The invention relates to a method for displaying an image stored in a raw image memory of a data processing system and includes the steps of:

supplying an image stored in a raw image memory to a portion of an all point addressable buffer connected to said display device;

displaying said stored image on a portion of a display screen in a reduced resolution form;

specifying through an input device a partial area within said displayed image;

defining an area in said image memory which corresponds to said specified partial area; and displaying an outlining indication of said partial area within said displayed image while simultaneously displaying an enlarged view of said partial area with full resolution on the remaining portion of said display screen.

DESCRIPTION OF THE DRAWINGS

FIGS. 6 and 7 show an exemplary image processing operation in accordance with the invention.

DESCRIPTION OF THE PREFERRED EMBODIMENTS

Figure 1:
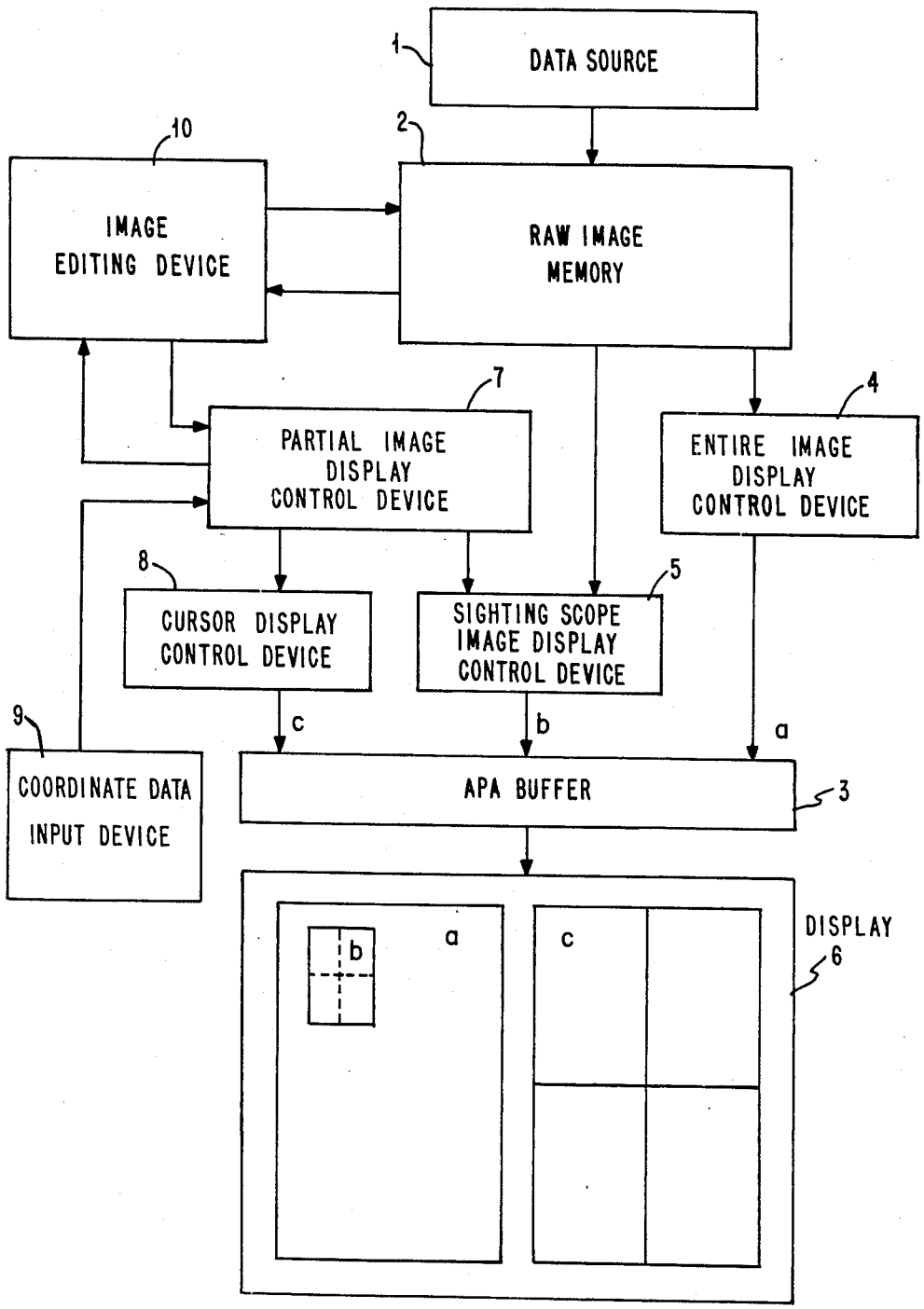
FIG. 1 shows a block diagram of a system for performing the process of the present invention.

FIG. 1 illustrates parts of a system for performing the processes of the present invention. Data source 1 (which could be a computer system, a data transmission line, or a device for scanning hard copy images) supplies image data to raw image memory 2. Image data from memory 2 is supplied to one part of an APA (all points addressable) buffer 3, through display control device 4, for forming a coarse resolution display of the entire image stored in memory 2. Data from memory 2 is also supplied to another part of APA buffer 3, through display control device 5, for forming a "sighting scope" (fine resolution enlarged) display of a portion of the image stored in memory 2.

APA buffer 3 connects directly to display device 6, for forming the coarse and fine resolution image displays just mentioned on separate viewing areas of that device's display screen. Storage bit positions in APA buffer 3 map directly onto display dot positions on the screen of device 6. Display control device 7 connects to display control device 8, for controlling formation of an outlining cursor image overlying the coarse image display, and also to device 5 for specifying selection of fine image data in accordance with the cursor position. Device 7 receives coordinate input data, for positioning the cursor image indication, from device 9 (e.g. a mouse, joystick or keyboard cursor positioning keys). Image editing device 10 connects between memory 2 and device 7 for performing editing functions relative to portions of displayed images outlined by the cursor (e.g.

move translations, mirror rotations, angular rotations, etc.).

Figure 2:
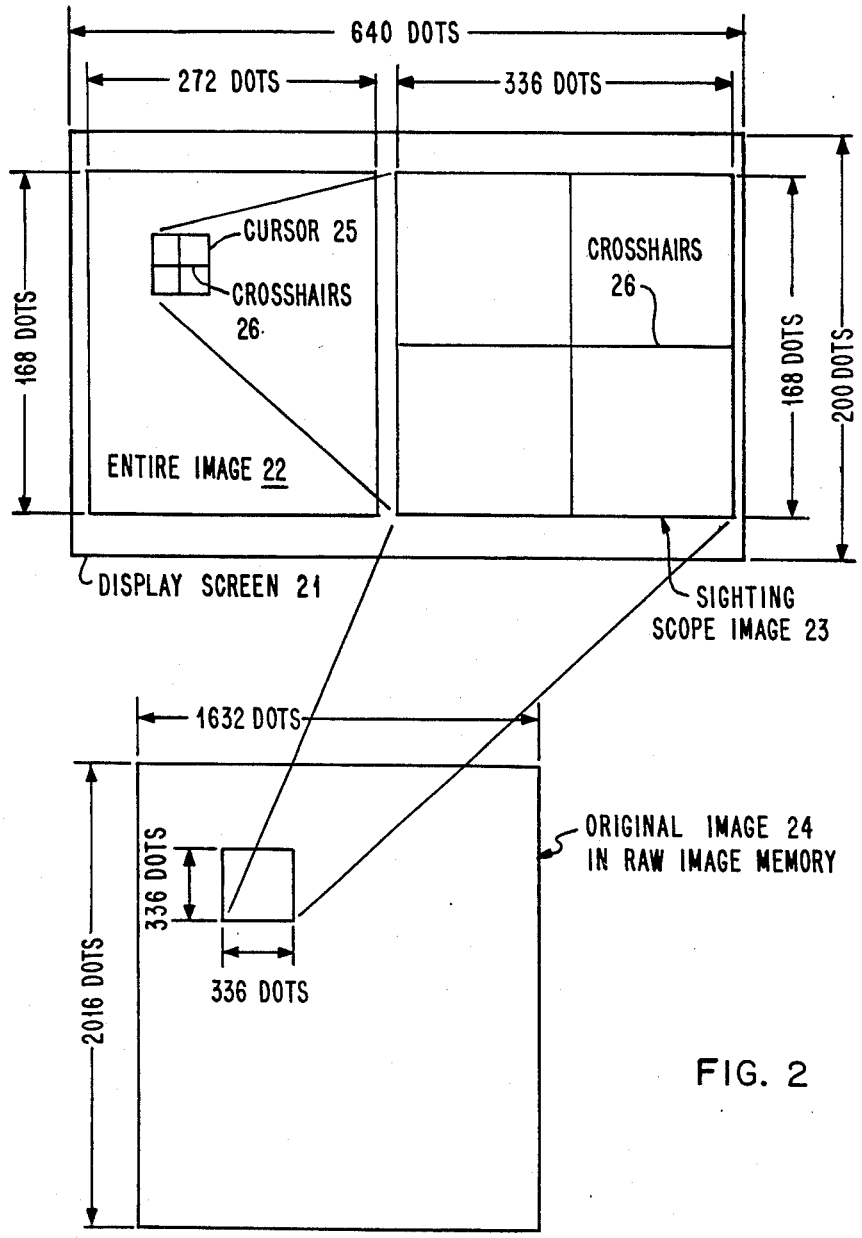
FIG. 2 shows the relationship between an original image stored in a raw image memory and both the corresponding displayed versions of both that image and a selected portion thereof.

FIG. 2 shows the relation between original image data 24, as stored in memory 2, and corresponding full and partial images, 22 and 23, respectively, as displayed on display screen 21. In the exemplary present embodiment, the stored full image 24 data consists of an array of 1632×2016 dot representations, but the display screen 21 contains only 640×200 display dot positions with a 2:1 dot aspect ratio (vertical:horizontal size). In accordance with the present invention, device 4 reduces the full image 24 to a corresponding coarse display image 22, in a rectangular area of 272×168 dots on screen 21, while device 7 uses a selected portion of the image data 24 to generate sighting scope (partial) display image 23 on a separate square area of 336×168 dots on screen 21 (the square form due to the aspect ratio above).

Figure 3:
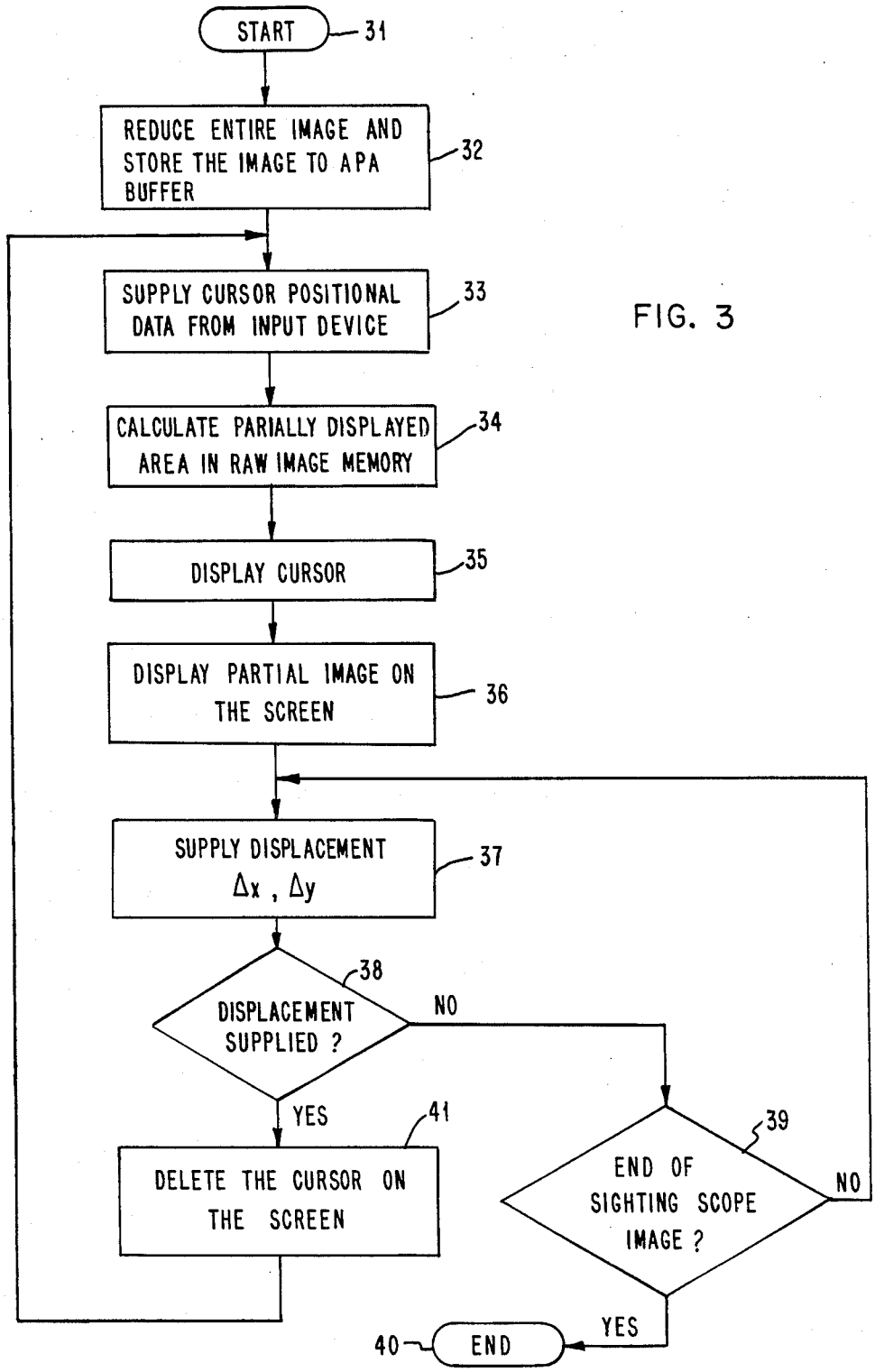
FIG. 3 shows an operational flow chart in accordance with the present invention.

The operations for producing the foregoing effects are described now with reference to FIGS. 1–3. Sequencing from "Start" function 31, operation 32 reduces the information in memory 2 to the form required for creating the corresponding coarse display image. Information in the latter form is stored in APA buffer 3, and causes the associated image 22 to be formed on screen 21. In the next operations 33–36, data supplied by input device 9 is used by devices 7 and 8 to generate the information for displaying outlining cursor 25 and crosshair indication 26 (FIG. 2), and also by devices 7 and 5 for selecting the image information from memory 2 for generating the sighting scope display image.

Figure 4:
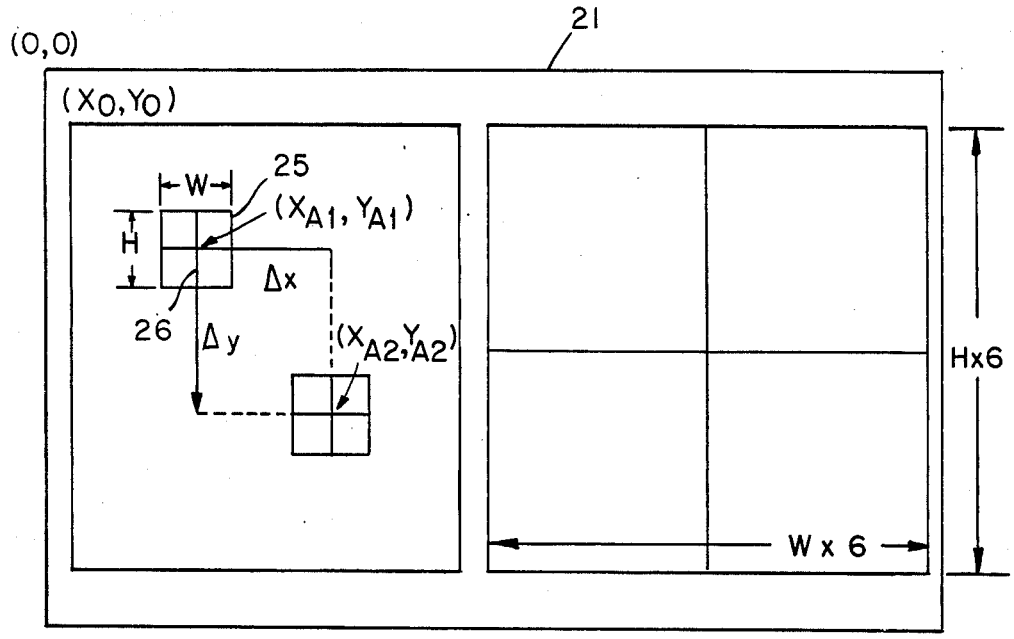
FIG. 4 shows various positional data in the raw image memory and the display screen.
Figure 4:
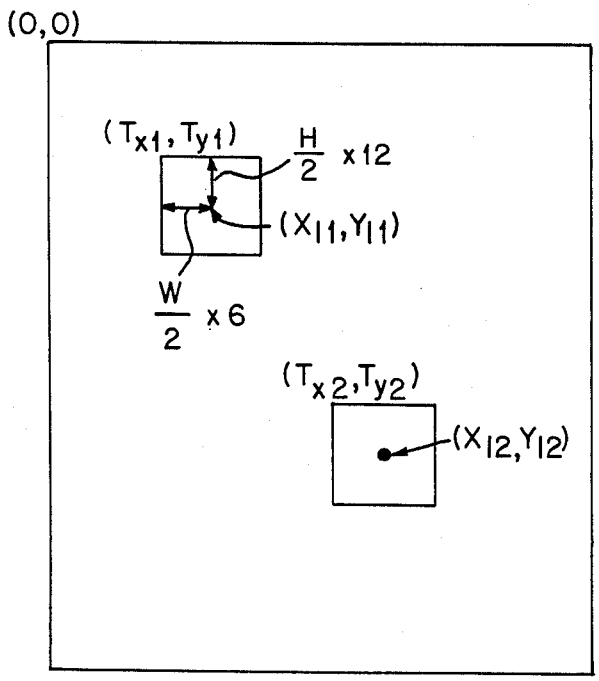

With reference to FIG. 4, input coordinates $X_{A1}$, $Y_{A1}$, from device 9, are used to determine addresses $X_{I1}$, $Y_{I1}$ for locating the sighting scope information in memory 2, in accordance with the following calculations (block 34):

$$X_{I1}=(X_{A1}-X_{\phi})\times 6$$

$$Y_{I1}=(Y_{A1}-Y_{\phi})\times 12$$

Display control device 7 also calculates the start or upper left position of the outlining cursor, relative to the full image output of memory 2, by the following calculations:

$$T_{X1}=X_{I1}-(W/2)\times 6$$

$$T_{Y1}=Y_{I1}-(H/2)\times 12$$

In the embodiment, the size of the sighting scope image display is fixed, and its location in memory is determined by device 7 from the address $T_{X1}$, $T_{Y1}$ and the fixed height (H) and width (W) parameters.

The information for tracing cursor and crosshair images is supplied to the APA buffer 3, by display control devices 7 and 8 (operation 35), so that respective cursor and crosshair images 25 and 26, are displayed over the appropriate part of the coarse image 22 (FIG. 2).

The information for the sighting scope image 23, starting with address $T_{X1}$, $T_{Y1}$ specified in block 34, is supplied to APA buffer 3 under control of devices 7 and 5, and displayed on the right side of the display screen 21.

Referring again to FIG. 3, actions 37–41 determine if the cursor position has changed, and selectively modify the information for the cursor and crosshair images 25 and 26, and retrieve new information for sighting scope image 23, if a change has occurred. If a change has not occurred during the current screen tracing of the sighting scope image (NO exit from decision 38 and YES exit from decision 39), the process terminates at END block 40. On such termination, image information in the APA buffer is used to repeatedly recreate the same images 22, 23, 25, 26. If a change occurs thereafter, the process is re-entered at 31, causing the process steps 32–37 to be repeated. If a change has not occurred and the image trace is still being formed (NO exits at both 38 and 39), operations 37 and 38 are repeated. If a change has occurred prior to or during the current image trace (YES exit at decision 38), the cursor image information in the APA buffer is erased (operation 41) and the process is re-entered at operation 33. In this circumstance, device 7 calculates a new cursor position $X_{A2}$, $Y_{A2}$ based upon the displacements dx and dy and the old cursor position $X_{Z1}$, $Y_{A1}$, and the operation sequences to block 34, wherein the start address $X_{X2}$, $T_{Y2}$ of the new partial image area is calculated. With this address, the information for the new sighting scope image is retrieved from memory 2. In succeeding blocks 35 and 36, the new cursor is displayed at $X_{A2}$, $Y_{A2}$, and the new partial image starting from $T_{X2}$, $T_{Y2}$ is displayed in enlarged form in sighting scope display area 23.

As described above, the cursor crosshairs 26 are displayed to relative scale on both the full image 22 and the enlarged sighting scope image 23. This enables an operator to accurately specify points within the sighting scope image for editing processes described below.

Figure 5:
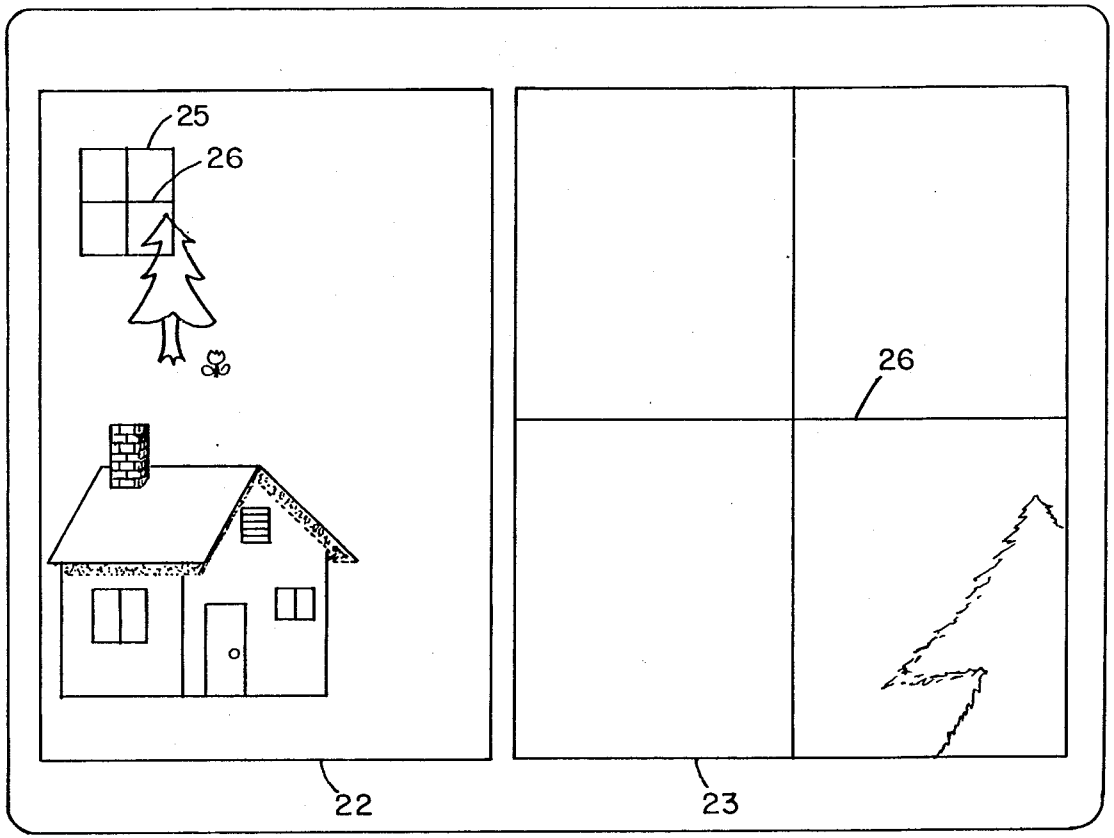
FIG. 5 shows one example of an image.

FIG. 5 shows an example of an image port which could be outlined by the cursor 25. It is apparent that the partial tree image outlined by cursor 25 in display area 22 is displayed in enlarged form in display area 23. Ordinarily, fine resolution display of the entire image would be highly desirable. However, due to the present limited number of pel positions on the display screen, the entire image can only be presented in a coarse form. This form does not permit an operator to precisely select or specify points within that image. With the subject invention, however, the operator can scan the entire coarse image by moving the cursor and simultaneously observe details within the outlined partial image. The detailed (or sighting scope) image is effectively scaled by the cursor crosshairs. By moving the cursor crosshairs on the rough image while observing the detailed partial image, the operator can specify any point within the latter image.

An image move operation, as one application of the present image processing operation, is shown in FIGS. 6 and 7. The objective of such move operation is to move an image in a source area of a computer memory to a destination area in the same memory (FIG. 7). Starting at 61 in FIG. 6, operations 62 and 63 select the start point A and end point B, which define the source area, in response to information developed with reference to cursor crosshair intersections placed successively at points A and B. In block 64, the start point C of a destination area is specified by corresponding positioning of cursor crosshairs 26. In operation 65, the image of the source area is moved to the destination area in the raw image memory 2, as shown in FIG. 7.

We claim:

1. A method for displaying an image on a display screen corresponding to information stored in a data processing system memory, wherein the stored information contains a predetermined first density of dot detail resolution, comprising:

extracting from said stored information a first subset of information representing the complete image but containing a second density of dot detail resolution less than said first density;

extracting from said stored information a second subset of information representing a selected portion of said complete image, said second subset containing a third density of dot detail resolution greater than said second density but not greater than said first density;

forming a split screen display containing discrete first and second display areas; and using said first and second extracted subsets, forming simultaneous coarse and fine resolution displays in said respective first and second areas of said respective complete image and selected portion thereof.

2. A method for displaying an image on a display screen corresponding to image information stored in a data processing system memory with a predetermined first resolution of dot information detail, comprising:

extracting from said stored information a first subset of information representing the complete image to be displayed and a second subset of information representing a selected portion of said complete image, said first subset having a second resolution of dot information detail less than said first resolution and said second subset having a third resolution of dot detail equal to said first resolution;

using said first subset of information, forming a complete view of said image on a first area portion of said screen with a coarse resolution appearance corresponding to said second resolution; and using said second subset of information, forming an enlarged view of said selected portion of said image on a second area portion of said screen discretely separate from said first portion and with a fine resolution appearance corresponding to said third resolution.

3. The method of claim 2 including:

forming an image representation of an outlining cursor; and displaying a view of said cursor on said first area portion of said screen overlying and outlining said selected portion of said image as viewed on said first portion of said screen, whereby the cursor indicates precisely the position and size of the selected portion relative to the complete image for convenient reference relative to the enlarged view of that selected portion simultaneously displayed on said second portion of said screen.

4. The method of claim 3 including:

displaying an enlarged view of said cursor on said second portion of said screen, overlying and outlining said enlarged view of said selected image portion.

5. The method of claim 3 wherein the area of said second portion of said screen is larger than the area of said first portion of said screen, whereby the view of said selected image portion is larger in size than the view of said complete image.

6. The method of claim 4 wherein said cursor is an image of a cross hair centered on the selected image portion.

* * * * *